United States Patent [19]

Suey

[11] Patent Number: 4,744,867

[45] Date of Patent: May 17, 1988

[54] DOOR LINER AND DOOR ASSEMBLY FOR A COKE OVEN

[76] Inventor: Paul V. Suey, 1043 Black Forest Dr., Pittsburgh, Pa. 15235

[21] Appl. No.: 932,884

[22] Filed: Nov. 20, 1986

[51] Int. Cl.[4] ..... C10B 25/06

[52] U.S. Cl. ..... 202/248; 202/242

[58] Field of Search ..... 202/248, 242, 268; 110/173 R; 49/483, 485

[56] References Cited

U.S. PATENT DOCUMENTS

| | | | |
|---|---|---|---|
| 2,993,845 | 7/1961 | Coe | 202/248 |
| 4,118,284 | 10/1978 | Bowman et al. | 202/248 |
| 4,197,163 | 4/1980 | Aikman | 202/248 |
| 4,217,177 | 8/1980 | Gerding et al. | 202/248 |
| 4,381,972 | 5/1983 | Stog | 202/248 |
| 4,414,072 | 11/1983 | Breidenbach et al. | 202/248 |

*Primary Examiner*—David L. Lacey
*Assistant Examiner*—Joye L. Woodard
*Attorney, Agent, or Firm*—Parmelee, Miller, Welsh & Kratz, P.C.

[57] ABSTRACT

A coke oven door liner comprises a first refractory layer, a second refractory layer and connecting means. The first refractory layer has an outer surface which is adapted to abut the inner surface of the coke oven door and has width and height dimensions which are substantially coextensive with those of the opening to the coke oven which is sealed by the coke oven door. The second refractory layer, disposed within the coke oven, has width and height dimensions substantially coextensive with those of the first refractory layer and is spaced apart from and generally parallel to the first refractory layer, thus creating an elongated chamber between the first and second refractory layers. A connecting means connects the second refractory layer to the first refractory layer and allows for gases created by burning coal within the coke oven to enter the elongated chamber created between the first and second refractory layers and rise to the top portion of the coke oven to be removed from the coke oven.

6 Claims, 4 Drawing Sheets

DOOR LINER AND DOOR ASSEMBLY FOR A COKE OVEN

BACKGROUND OF THE INVENTION

The invention relates to a door liner and door assembly for a coke oven.

Typical coke oven doors are refractory-lined metal. The refractory lining or door plug is solid and relatively thick and serves to insulate the metal door from the high temperatures, up to about 2800° F. (1535° C.), reached within the coke oven. The metal portion of the door seals the oven at the outer portion of the door frame. The refractory lining generally exends into the coke oven to a distance just past an imaginary line extending between the outermost surface of the end flues located one on either side of the door.

One problem associated with many coke ovens is the lack of a passageway extending vertically to carry the gases generated by the coking coal to the top of the oven to be collected and withdrawn from the coke oven. Thus, the gases must percolate vertically through the densely packed coal. The gases that cannot percolate vertically create a great deal of pressure on the door seal and some of the gases escape to the atmosphere.

As mentioned, the refractory lining has heretofore generally been solid. It has also been known to provide a door plug that is spaced apart from the metal door to create a gas channel extending vertically between the inside surface of the metal door, the outer door jambs, the sealing ring and the outer surface of the door plug. A problem associated with this design is that the gases generated by the coking coal condense on the inside surface of the metal door and door jambs because the temperature in the gas channel is below the 950° F. (516° C.) temperature at which the gases condense. The condensed gases solidify to a hard dense hydrocarbon that interferes with the seal between the metal door and the jambs and restricts the gas channel area.

Thus, it is desired to create a door liner and door assembly for a coke oven, in which coal is coked and gases are generated, having a space through which the gases can travel to the top of the oven for withdrawl from the coke oven.

SUMMARY OF THE INVENTION

A coke oven door liner comprises a first refractory layer, a second refractory layer and connecting means. The first refractory layer has an outer surface which is adapted to abut the inner surface of the coke oven door and has width and height dimensions which are substantially coextensive with those of the opening to the coke oven which is sealed by the coke oven door. The second refractory layer, disposed within the coke oven, has width and height dimensions substantially coextensive with those of the first refractory layer and is spaced apart from and generally parallel to the first refractory layer, thus creating an elongated chamber between the first and second refractory layers. A connecting means connects the second refractory layer to the first refractory layer and allows for gases created by coking coal within the coke oven to enter the elongated chamber created between the first and second refractory layers and rise to the top portion of the coke oven to be removed from the coke oven.

A coke oven door assembly comprises a door, a first refractory layer, a second refractory layer and connecting means. The door is adapted to seal an opening in the coke oven and has an inner surface adapted to seal an opening in the coke oven. The first refractory layer has an outer surface which is adapted to abut the inner surface of the door and has width and height dimensions substantially coextensive with the opening to the coke oven. The second refractory layer, disposed within the coke oven, has width and height dimensions substantially coextensive with those of the first refractory layer and is spaced apart from and generally parallel to the first refractory layer, thus creating a chamber between the first and second refractory layers. A connecting means connects the second refractory layer to the first refractory layer and allows for gases created by coking coal within the coke oven to enter the elongated chamber created between the first and second refractory layers and rise to the top portion of the coke oven to be removed from the coke oven.

The first refractory layer protects the coke oven door from contact with the gases created by the coking coal. Thus, the gases can not condense on the metal coke oven door. In addition, because the refractory material from which the first refractory layer is formed is not very thermally conductive, the gases created by the coking coal will not likely condense on the first refractory layer.

These and other objects of the invention will be more fully understood from the following description of the invention and accompanying drawings.

DETAILED DESCRIPTION OF THE PREFERRED EMBODIMENT

Figure 1:
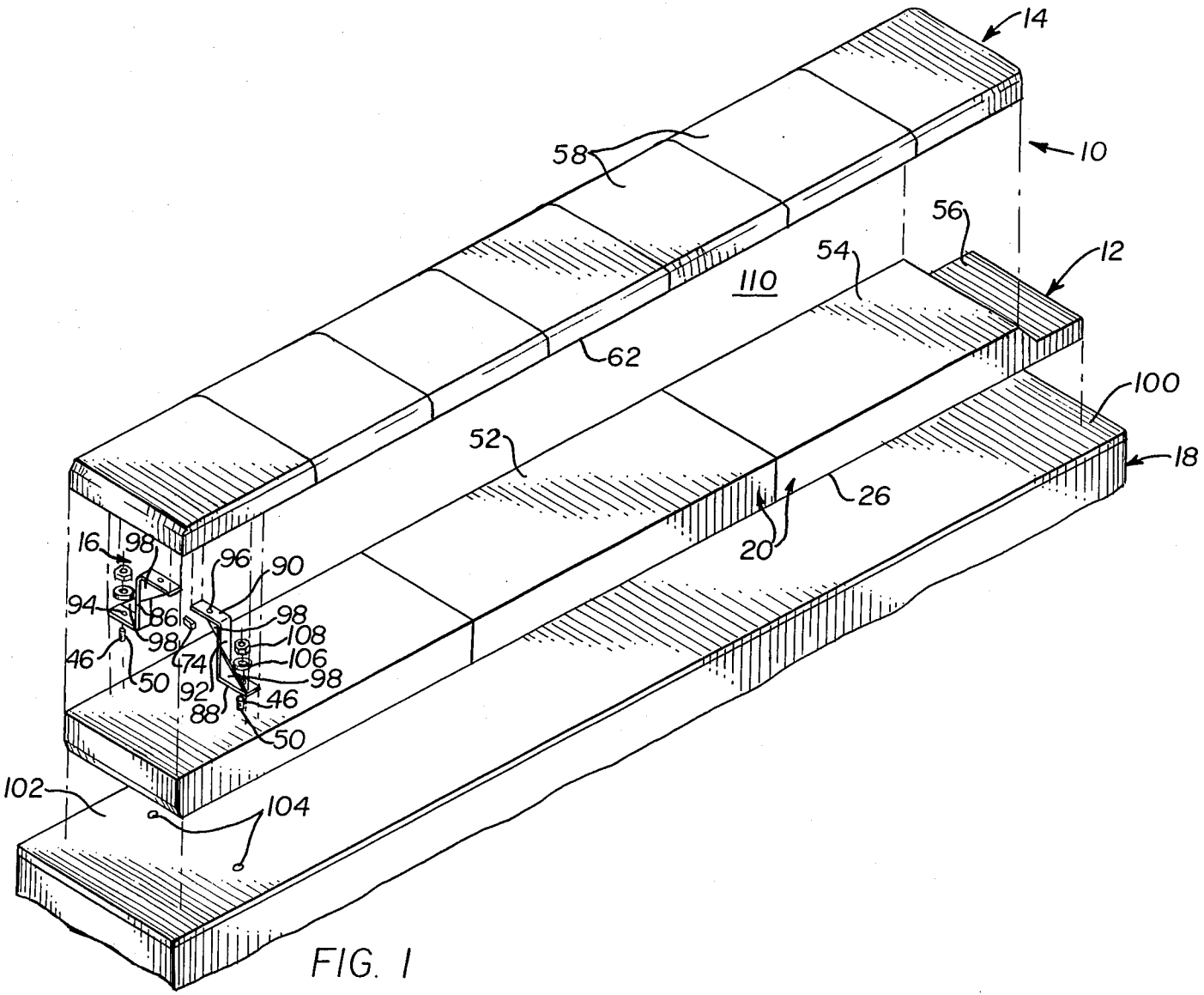
FIG. 1 is an exploded view of a coke oven door for the coking side of the coke oven having a door liner of the present invention.

The door liner 10 of the present invention includes a first refractory layer 12, a second refractory layer 14 and connecting means 16. The present invention applies to a door liner 10 for a coke oven door 18 to either the coking side or the pusher side of the coke oven. The invention will first be described with respect to a door liner for a coke oven door 18 to the coking side of the coking chamber.

The first refractory layer 12 has a width and height dimension substantially coextensive with those of the opening to the coke oven which the coke oven door 18 is to seal and has a generally rectangular cross-section. The first refractory layer 12 is formed of a plurality of abutting, vertically aligned sections 20, shortened along the height dimension of the first refractory layer 12 for ease of handling and ease of repair. The space between the vertical sections 20 is minimized to prevent heat loss through the space and subsequent condensation of the gases on the coke oven door 18.

Figure 5:
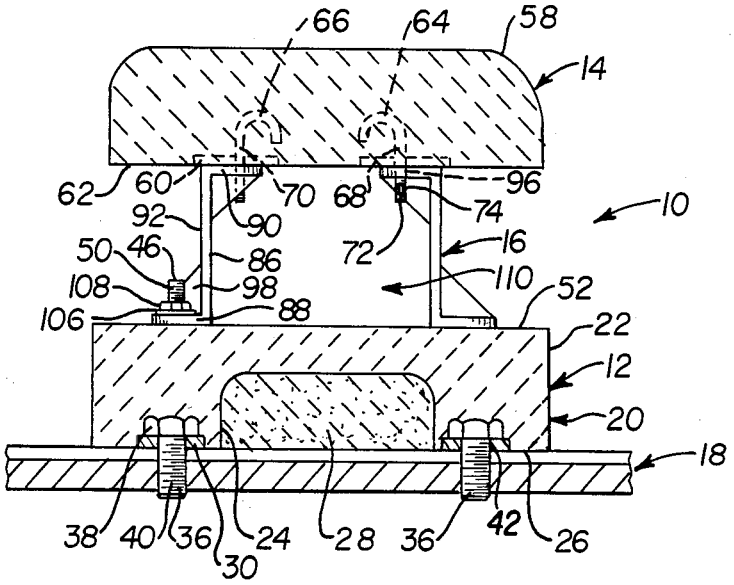
FIG. 5 is a cross-sectional view taken along the line V—V of the door liner shown in FIG. 2.
Figure 6:
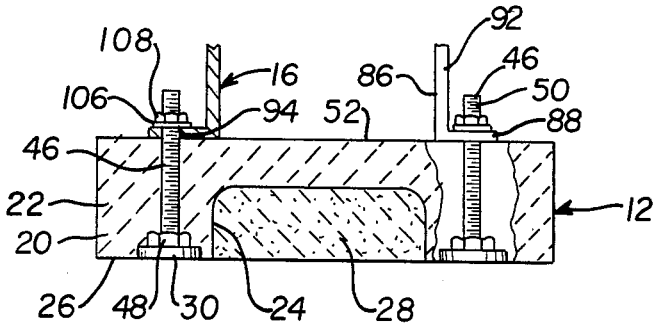
FIG. 6 is a cross-sectional view, taken along the line VI—VI of FIG. 2 of the first refractory layer.
Figure 7:
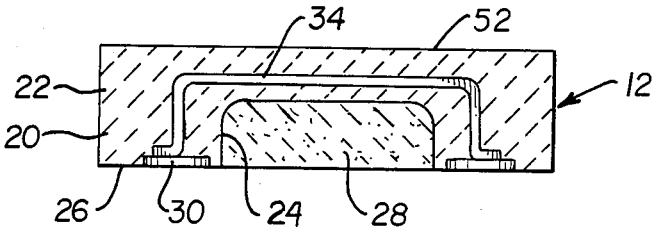
FIG. 7 is a cross-sectional view, taken along the line VII—VII of FIG. 2, of the first refractory layer.

Each vertical section 20 of the first refractory layer 12 includes a refractory portion 22 having a generally C-shaped cross-section (FIGS. 5, 6 and 7) with a recess 24 formed in the outer, or door-facing, surface 26 of each vertical section 20. Suitable refractory materials from which the refractory portions 22 of the vertical sections 20 can be formed include hi-alumina castable refractories. The recess 24 in the outer surface 26 of each vertical section 20 is filled with insulating material 28, preferably of a suitable ceramic fiber insulation such as that available from Carborundum Company under the trademark Fiberfrax® or available from Babcock & Wilcox Co. under the trademark Kaowool®. The insulating material 28 provides insulation superior to that of the refractory material alone.

Figure 3:
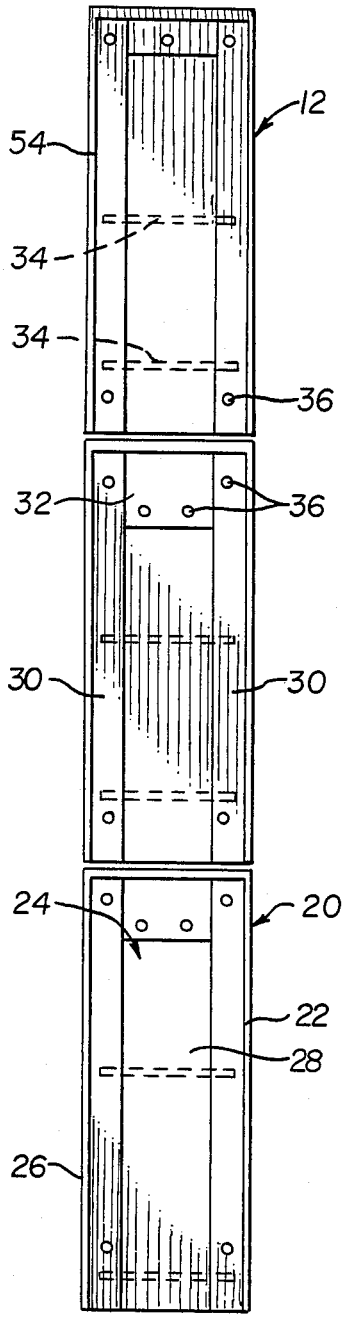
FIG. 3 is a bottom plan view, partly in section, of the first refractory layer of the door liner shown in FIG. 1.
Figure 4:
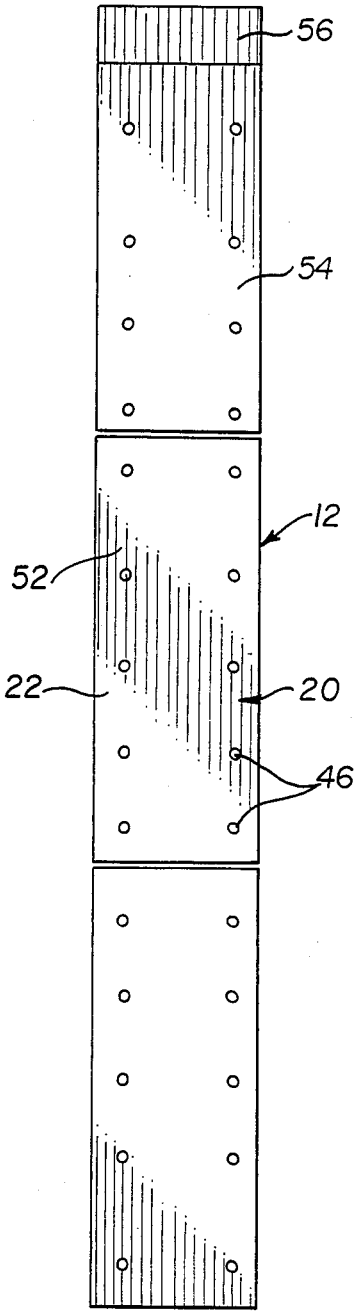
FIG. 4 is a top plan view of the first refractory layer of the door liner shown in FIG. 1.

Each refractory portion 22 is cast about two metal strips 30 disposed one along each side of the outer surface 26 of the refractory portion 22 and a metal strip 32 is disposed along the top of the outer surface 26 of the refractory portion 22 (FIG. 3). The outer surfaces of the metal strips 30 and 32 are flush with the outer surfaces 26 of the refractory portions 22. A plurality of C-shaped metal cross-braces 34 (FIG. 7) are embedded within each refractory portion 22 to strengthen the structure. C-shaped cross-braces 34 are welded to the metal strips 30.

Figure 2:
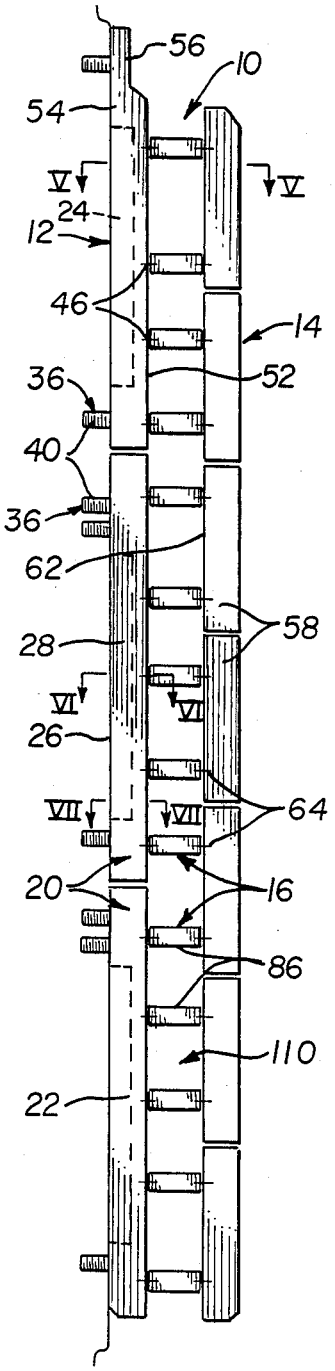
FIG. 2 is a side sectional view of the door liner shown in FIG. 1.

Bolts 36 (FIGS. 2 and 3) are partially embedded within each refractory portion 22 as they are cast. The head portions 38 of the bolts 36 are held within the refractory portions 22 and the threaded ends 40 of the bolts 36 protrude from the outer surfaces 26 of the refractory portions 22 through bores 42 in the metal strips 30 and 32. The bolts 36 enable the first refractory layer 12 to be secured to the coke oven door 18.

Figure 8:
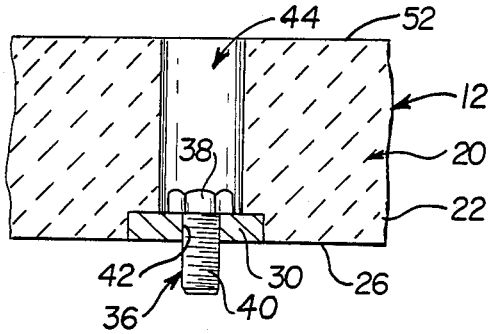
FIG. 8 is a cross-sectional view showing an alternative embodiment of the first refractory layer.

Alternatively, as shown in FIG. 8, the bolts 36 can be disposed through bores 44 aligned with the bores 42 in the metal strip 30 and 32 and drilled through the refractory portions 22 after they are cast. The bores 44 would then be filled with a suitable refractory material.

A plurality of bolts 46 (FIGS. 1, 2, 4, 5 and 6) are partially embedded within the refractory portions 22 as they are cast. The head portions 48 of the bolts 46 are embedded within the refractory portions 22 and are tack welded to the metal strips 30 or 32. The threaded ends 50 of the bolts 46 protrude from the inner surfaces 52 of the refractory portions 22. The bolts 46 enable the first refractory layer 12 to be secured to the connecting means 16.

The topmost vertical section 20 of the first refractory layer, labeled 54, includes an extension 56 which is thinner than the remainder of the first refractory layer 12.

The second refractory layer 14 has a width dimension substantially coextensive with that of the first refractory layer 12 and a height dimension which extends to the lower edge of the extension 56 of the vertical section 54 of the first refractory layer 12. Generally, the second refractory layer 14 is formed of a plurality of abutting, vertically aligned sections 58, shortened along the height dimension of the second refractory layer 14 for ease of handling and ease of repair. The space between the vertical sections 58 is minimized to prevent heat loss through the space. The vertical sections 58 are formed of a suitable refractory material such as those previously mentioned with respect to the refractory portions 22 of the vertical sections 20 of the first refractory layer 12.

Figure 10:
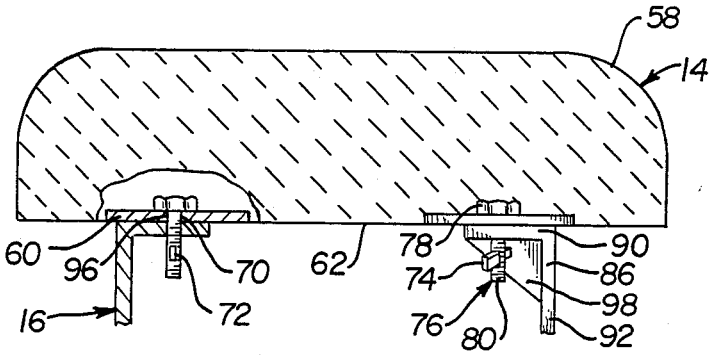
FIG. 10 is a cross-sectional view showing an alternative embodiment of the second refractory layer.
Figure 9:
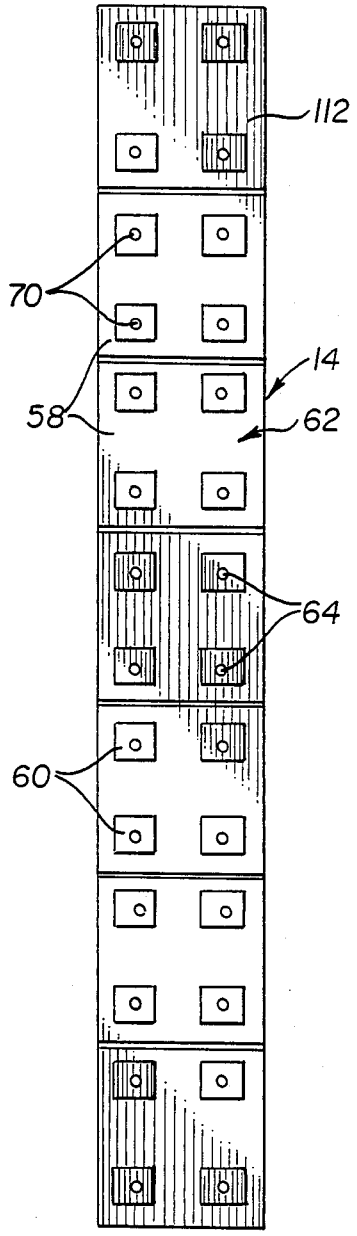
FIG. 9 is a bottom plan view of the second refractory layer of the door liner shown in FIG. 1.

A plurality of metal plates 60, (FIGS. 5, 9 and 10) are embedded within vertical sections 58 of the second refractory layer 14 so that the outer surfaces of the metal plates 60 are flush with the outer surfaces 62 of the vertical sections 58. A plurality of J-shaped bolts 64 (FIG. 5) are partially embedded within the vertical sections 58 of the second refractory layer 14 so that the curved portions 66 of the J-shaped bolts 64 are encased within the vertical sections 58 and the straight portions 68 of the J-shaped bolts 64 extend through bores 70 in the metal plates 60 and protrude from the outer surfaces 62 of the vertical sections 58. Each straight portion 68 of a J-shaped bolt 64 includes a slot 72 at its lower end adapted to receive a wedge 74.

It will be understood by those of ordinary skill in the art that many other fastening means are suitable to secure the connecting means 16 to the second refractory layer. For instance, in an alternate embodiment, shown in FIG. 10, bolts 76 replace the J-shaped bolts 64 in the second refractory layers 14. The head ends 78 of the bolts 76 are embedded within the vertical sections 58 of the second refractory layer 14 as the vertical sections 58 are cast. The lower ends 80 of the bolts 76 extends through bores 70 in the metal plates 60 and protrude from the outer surfaces 62 of the vertical sections 58. In addition, threaded bolts, secured with washers and nuts, can replace the J-shaped bolts 64 and wedges 74.

The connecting means 16 is preferably a plurality of Z-shaped bars 86, (FIGS. 1 and 5) each having a pair of spaced, oppositely directed, generally parallel legs 88 and 90 connected by a middle section 92. However, the connecting means 16 can take any form that will secure the first and second refractory layers 12 and 14 together in a spaced relationship. Other possible configurations of connecting means include I and C-shaped bars. Generally the Z-shaped bars 86 are disposed in pairs forming two vertical rows along the vertical axis of the door liner. Further, the legs 88 of each pair of Z-shaped bars 86 extend outwardly and away from each other, whereas the legs 90 of each pair of Z-shaped bars 86 extend inwardly and towards each other.

Each leg 88 of the Z-shaped bars 86 includes a bore 94 whch is adapted to receive a threaded portion 50 of a bolt 46 from the first refractory layer 12 as each leg 88 of the Z-shaped bars 86 abuts, and is secured to the first refractory layer 12. Similarly, each leg 90 of Z-shaped bars 86 includes a bore 96 therethrough which is adapted to receive a straight portion 68 of a J-shaped bolt 64 from the second refractory layer 14 as each leg 90 of the Z-shaped bars 86 abuts, and is secured to the second refractory layer 14. The legs 88 and 90 of the Z-shaped bars 86 are braced with triangular braces 98 disposed one against each leg on opposite sides of the middle portion 92 of the Z-shaped bar 86.

The first refractory layer 12 is secured to the coke oven door 18 through a door frame 100. The door frame 100 is a solid metal plate which is substantially coextensive with the coke oven door 18. The door frame 100 is secured to the remainder of the coke oven door 18 through bolts, not shown. The exposed surface 102 of the frame 100 forms the inner surface of the coke oven door 18. The outer surfaces 26 of the vertical sections 20 of the first refractory layer 12 abut the exposed surface 102 of the door frame 100. The door frame 100 includes bores 104 therethrough, through which the threaded ends 40 of the bolts 36 are disposed. Washers and nuts (not shown) can then be threaded on the threaded ends 40 of the bolts 36 and tightened against the door frame 100 to the first refractory layer 12 to the door frame 100 of the coke oven door 18. In the alternate embodiment shown in FIG. 8, the bores 104 through the door frame 100 are threaded. The bolts 36 are tightened by turning the bolts 36 in the bores 44 so that the threaded ends 40 of the bolts 36 engage the threaded bores 104 of the door frame 100.

The first refractory layer 12 is secured to the second refractory layer 14 through the Z-shaped bars 86 of the connecting means 16. In order to secure each leg 88 of the Z-shaped bars 86 to the first refractory layer 12, the threaded ends 50 of the bolts 46 in the first refractory layer 12 are disposed through the bores 94 in the legs 88 of the Z-shaped bars 86. Washers 106 are threaded over the threaded ends 50 of the bolts 46 and nuts 108 are then threaded over the threaded ends 50 of the bolts 46 and tightened against the legs 82 of the Z-shaped bars 86.

In order to secure each leg 90 of the Z-shaped bars 86 to the second refractory layer 14, the straight portions 68 of the J-shaped bolts 64 in the second refractory layer 14 are disposed through bores 96 in the legs 90 of the Z-shaped bars 80. Wedges 74 are then inserted through and tack welded within the slots 72 in the straight portions 68 of the J-shaped bolts 64.

Thus, the middle sections 92 of the Z-shaped bars 86 span the space between the first and second refractory layers 12 and 14 to define an elongated chamber 110. Gases from the coal burning within the coke oven can, in addition to percolating upwardly through the coking coal, travel horizontally through the coking coal, enter the elongated chamber 110 and flow vertically through the elongated chamber 110 and be removed from the top of coke oven.

The door liner 10 preferably extends into the coke oven to a distance just past an imaginary line extending between the outermost surface of the end flues (not shown), located one on either side of the coke oven door assembly.

Figure 11:
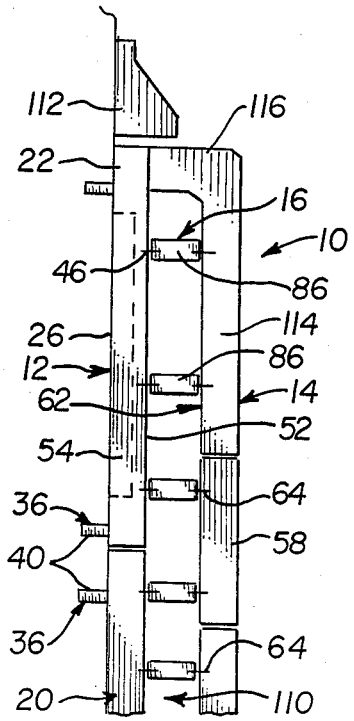
FIG. 11 is a side sectional view of the top portion of a door liner of the present invention for a coke oven door for the pusher side of the coke oven.

As shown in FIG. 11, the design of the door liner 10 is modified from that described above for use on the door to the pusher side of the coke oven. The door liner 10 extends to a level just below that of the opening in the coke oven door 112 for the leveler to be inserted into the coking chamber to level the coal once the coke oven has been charged. Further, to prevent any coal from being raked into the elongated chamber 110 created between the first and second refractory layers 12 and 14 as the coal is leveled, the topmost vertical section 58 of the second refractory layer 14, labeled 114, is L-shaped and includes an extension 116 at its uppermost end that projects generally perpendicularly from the second refractory layer 14 to the first refractory layer 12 and covers the top of the elongated chamber 110 between the first and second refractory layers 12 and 14.

I claim:

1. A coke oven door liner and door assembly adapted to seal an opening in a coke oven having a lower portion in which coal is coked, a top portion from which gases created by the coking coal are removed from the coke oven and at least one opening thereto which is sealed by said door, said door having an inner surface facing within the coke oven, said coke oven door liner comprising:

a first refractory layer having an outer surface adapted to abut said inner surface of said door, said first refractory layer having width and height dimensions substantially coextensive with those of a coke oven opening which is to be sealed by said door;

a second refractory layer spaced apart from and generally parallel to said first refractory layer, thus creating an elongated chamber between said first and second refractory layers, said second refractory layer having width and height dimensions substantially coextensive with those of said first refractory layer;

said first and second refractory layers formed of a plurality of abutting, vertically aligned sections;

the outer surface of each of said sections of said first refractory layer having a recess therein which is filled with an insulating material; and connecting means for connecting said second refractory layer to said first refractory layer;

whereby gases created by the coking coal enter said elongated chamber between said first and second spaced apart parallel refractory layers and rise to the top portion of said chamber to be removed therefrom.

2. The coke oven door liner and door assembly of claim 1 wherein said connecting means is a plurality of bars abutting said first and second refractory layers spanning said elongated chamber between said first and second refractory layers.

3. The coke oven door liner and door assembly of claim 2 wherein said bars are Z-shaped, having first and second spaced, substantially parallel legs and a middle section connnecting said legs, wherein said first leg abuts said first refractory layer, said second leg abuts said second refractory layer, and said middle section spans said elongated chamber between said first and second refractory layers.

4. A coke oven door assembly in combination with a coke oven, the coke oven having at least one opening thereto which is sealed by a coke oven door, a lower portion in which coal is coked and a top portion from which gases created by the coking coal are removed from the coke oven, said door assembly comprising:

a door adapted to seal said opening in said coke oven, and having an inner surface adapted to face within said coke oven;

a first refractory layer having an outer surface adapted to abut said inner surface of said door, said first refractory layer having width and height dimensions substantially coextensive with those of said opening to said coke oven;

a second refractory layer, disposed within said coking chamber, spaced apart from and generally parallel to said first refractory layer, thus creating an elongated chamber between said first and second layers, said second refractory layer having width and height dimensions and substantially coextensive with those of the first refractory layer;

said first and second refractory layers formed of a plurality of abutting, vertically aligned sections;

the outer surface of each of said sections of said first refractory layer having a recess therein which is filled with an insulating material; and connecting means for connecting said second refractory layer to said first refractory layer;

whereby gases created by the coking coal enter said elongated chamber between said first and second spaced apart parallel refractory layers and rise to the top portion of said coke oven to be removed therefrom.

5. The combination of claim 4 wherein said connecting means is a plurality of bars abutting said first and second refractory layers and spanning said elongated chamber between said first and second refractory layers.

6. The combination of claim 5 wherein said bars are Z-shaped, having first and second spaced, substantially parallel legs and a middle section connecting said legs, wherein said first leg abuts said first refractory layer, said second leg abuts said second refractory layer, and said middle section spans said elongated chamber between said first and second refractory layers.

* * * * *